US010690461B2

(12) United States Patent
Huntsman

(10) Patent No.: US 10,690,461 B2
(45) Date of Patent: Jun. 23, 2020

(54) ARCHERY BROADHEAD AIR FLOW INTERRUPTER

(71) Applicant: Shane Darin Huntsman, North Salt Lake, UT (US)

(72) Inventor: Shane Darin Huntsman, North Salt Lake, UT (US)

( * ) Notice: Subject to any disclaimer, the term of this patent is extended or adjusted under 35 U.S.C. 154(b) by 0 days.

(21) Appl. No.: 16/278,067

(22) Filed: Feb. 16, 2019

(65) Prior Publication Data

US 2019/0257626 A1 Aug. 22, 2019

Related U.S. Application Data

(60) Provisional application No. 62/634,180, filed on Feb. 22, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 3,110,336 A * 11/1963 Sukala, Jr. ..... F42B 6/08 150/154
3,672,677 A * 6/1972 Moore ..... F42B 6/08 473/578
4,093,230 A * 6/1978 Simo ..... F42B 6/08 30/151
4,676,512 A * 6/1987 Simo ..... F42B 6/08 473/584
5,064,202 A * 11/1991 Barner ..... F42B 6/08 473/583
5,842,942 A * 12/1998 Doht ..... F42B 6/02 473/578
5,871,410 A * 2/1999 Simo ..... F42B 6/08 473/583
6,203,456 B1 * 3/2001 Ossege ..... F41B 5/12 473/578
6,394,919 B1 * 5/2002 Ossege ..... F41B 5/12 124/23.1
6,863,630 B1 * 3/2005 Watkins ..... F42B 6/08 473/583
7,325,319 B2 * 2/2008 Smith ..... F41G 1/467 124/87
7,393,295 B1 * 7/2008 Futtere ..... F42B 6/08 473/583
7,434,684 B1 * 10/2008 Mabra ..... F41B 5/14 206/315.11
9,347,751 B2 * 5/2016 Hollars ..... F42B 12/34
10,066,912 B2 * 9/2018 Grace ..... A63B 69/00
2010/0031945 A1 * 2/2010 Shaffer ..... F41B 5/1469 124/86

* cited by examiner

*Primary Examiner* — Alexander R Niconovich
(74) *Attorney, Agent, or Firm* — J. Todd Rushton

(57) ABSTRACT

An archery broadhead air flow interrupter or an attachment for a broadhead configured to fit over the point of the broadhead and prior to the primary cutting blades; the air flow interrupter creating a turbulent low pressure zone around the cutting blades, preventing broadhead planing, and improving the accuracy of the broadhead archery point.

13 Claims, 9 Drawing Sheets

ARCHERY BROADHEAD AIR FLOW INTERRUPTER

The present application claims priority to United States Provisional Application 62/634,180, filed Feb. 22, 2018.

BACKGROUND

The disclosure of the present invention relates to archery broadheads or more specifically to an air flow interrupter configured to be fitted on the point of an archery broadhead and improve the accuracy and flight of an arrow by disrupting laminar air flow prior to the air passing over the planar cutting blades.

Increasing the width and number of cutting blades is recognized as the primary solution for optimizing the lethal effectiveness of a broadhead. Additional cutting width, and a higher number of cutting surfaces, increases the overall trauma to muscle, arteries and vital organs; allowing for a quicker and more humane animal harvest. Additionally, the majority of broadheads include a sharp ferrule point preceding the cutting blades, the ferrule point is configured to optimally penetrate and fracture bone and to ensure a shot animal stays down for quicker recovery by the hunter.

However, it is recognized that there are performance issues associated with the increased surface area of the cutting blades including, but not limited to "broadhead planing" or the effect of the broadhead blades acting as, wings or foils, causing an arrow to rise or steer away from the intended target. The planing effect becomes more pronounced with the faster velocity compound bows and lightweight arrows.

The industry has responded by introducing broadheads having mechanical blades that remain in a retracted position against the ferrule during flight and extend away from the ferrule upon impact. These can be an effective solution for planing but most mechanical points are expensive and do not survive more than a single use.

It has also been recognized that by disturbing the airflow prior to it passing over the cutting blades of a broadhead produces a more accurate flight. US patent application 2008/0039249A1 by Roberts for a Broadhead Point includes a bulbous shoulder formed at the point of the ferrule prior to the cutting blades, the applicant expressed that the shoulder creates a low pressure zone behind the point to improve the flight of the arrow. This configuration where the shoulder is formed as an integral part of the ferrule point creates a blunt portion prior to the cutting blades and may act to limit the penetration and overall effectiveness of the ferrule point.

What is needed is an apparatus configured to displace air prior to the air passing over the surface of the cutting blades to improve accuracy but will also not limit the effectiveness of the sharp ferrule point.

SUMMARY OF THE INVENTION

The present invention is an Archery Broadhead Air Flow Interrupter or more specifically, a cover, cap, or washer, configured to fit over the broadhead ferrule point; the cover having a diameter greater than the diameter of the ferrule point and sized to provide a turbulent low pressure zone that envelopes a substantial portion of the cutting blade surface area.

It is recognized that laminar air flow over a surface creates greater force than a turbulent air stream, traveling, or passing, over the same surface, at the same velocity, and that the overall force differential between the laminar air flow and the turbulent air flow increases factorial as the velocity increases. Therefore, the benefit of an air flow interrupter is greatest when using a high velocity bow and a lightweight arrow configured to achieve maximum arrow velocity. The air flow interrupter also allows a user to shoot older broadheads designs that are proven to be effective for taking an animal but may not fly well, or shoot accurately, with a modern high velocity bow. It is recognized that a variety of shapes will work as an air flow interrupter and that streamlined aerodynamics is not a principle concern when considering the effect of the air flow interrupter on arrow velocity when shot at a target which is within a responsible range. It is contemplated that the air flow interrupter can be shaped as a cone, a frusto-conical shape, cylinder, sphere, elongate orb or similar shape having a symmetrical cross-section along the horizon axis. The outside surface of the interrupter may be planer, have convex or concave variations or may include one or more rings, ridges or other protuberances configured to disrupt laminar air flow prior to the air passing over the cutting blades of the broadhead.

In a first embodiment of an archery broadhead air flow interrupter, the air flow interrupter is configured as a conical cap having a tip or point and a substantially planar surface extending down to a straight bottom edge or skirt. The air flow interrupter formed with an opening in the bottom surface configured to fit over, and securely engage, the sharp point of a ferrule tip. The air flow interrupter is designed to displace air around the broadhead blades during flight but be pierced or break away at impact of a targeted animal; therefore the interrupter is designed for a single use, or is considered a sacrificial component of a broadhead. One embodiment of the air flow interrupter is made using an elastomeric material, such as a soft plastic, silicon or similar material. The elastomeric material allows the interrupter to be fitted over a variety of broadhead ferrule points; including ferrule points having different diameters or ferrule points having an irregular surface or chisel point configured to fracture bone and ferrule points including a groove formed specifically to retain and air flow interrupter. Another embodiment of the air flow interrupter may be made of a rigid material, such as wood, plastic or nylon. A rigid interrupter would be designed to fit a specific broadhead or a series of broadheads having a ferrule point of specific shape or diameter. Rigid interrupters may also include one or more relief lines or parting lines configured to facilitate fracture or release of the interrupter at impact.

One embodiment of the interrupter may be formed using organic or compostable materials, such as, corn starch, potato starch, soybean protein, cellulose or other organic materials yet to be exploited. Using a compostable material will allow any detached remnants of the interrupter to degrade into the soil when left in the field.

Another embodiment of the air flow interrupter is formed as an extended cone having a sharp point tapering down on a convex curve to a flared bottom edge or skirt. It is recognized that the convex surface and flared skirt will created greater deflection of the laminar air flow and will create a wider zone of turbulence behind the interrupter. In yet another embodiment, the outside surface of the air flow interrupter may include a plurality of recessed slots or scoops configured to again create a greater zone of turbulence or low pressure air.

One embodiment of the air flow interrupter is configured as a ring or a washer configured to fit over the ferrule leaving the sharp point exposed. The washer having a broad planer surface which extends the diameter of the ferrule point creating a zone of turbulence in front of the broadhead blades. The center opening of the washer may be circular or may have a pattern configured to match cutouts or scallops formed in the point of a specific broadhead. It is contemplated that an interrupter formed as a ring or a washer may be configured to be reusable, having sufficient rigidity to withstand and interrupt the air flowing over the broadhead but also have enough flexibility to fold substantially flat against the ferrule when the broadhead penetrates a target. The air flow interrupter washer may include a plurality of stiffening fins on the underside of the washer or may be comprised of compressible open cell foam. In one embodiment, the ferrule will include a groove formed just below the tapered point of the broad head configured to retain an air flow interrupter.

In yet another embodiment, the air flow interrupter may have an engineered shape configured to create a turbulence zones greater than the diameter of the interrupter. In one embodiment the interrupter can be formed substantially as a cone having a bulbous portion or ramp formed below the point, the ramp configured promote laminar air flow over the ramp and into a reverse scoop formed at the base or in the skirt of the interrupter. The reverse scoop configured to create a violent zone of turbulence just prior to the base of the interrupter. It is contemplated that this zone of turbulence will intercept a broader area of laminar air flow before the air passes over the cutting blades.

One embodiment of the present invention or air flow interrupter includes an extended skirt or a secondary skirt configured to extended into, and be cut by, the broadhead cutting blades. The secondary skirt creating an increased contact area and greater retention force on the ferrule point.

BRIEF DESCRIPTION OF DRAWINGS

The following description of the embodiments can be understood in light of the Figures, which illustrate specific aspects of the embodiments and are part of the specification. Together with the following description, the Figures demonstrate and explain the principles of the embodiments.

DETAILED DESCRIPTION OF THE DRAWINGS

Figure 1A:
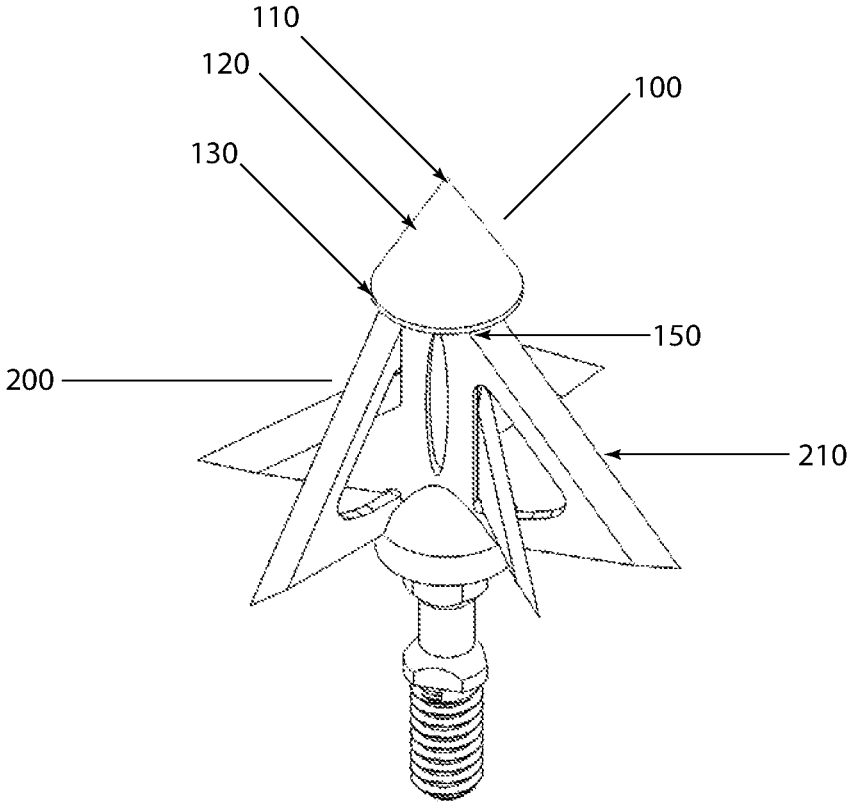
FIG. 1A-1B a first embodiment of the present invention or air flow interrupter, FIG. 2A-2B an embodiment of an air flow interrupter having an extended convex body portion, FIG. 3A-3B an embodiment of an air flow interrupter having an extended convex body portion and a plurality of scoops formed in the body, FIG. 4A-4B an embodiment of an air flow interrupter formed as a washer, and, FIG. 5 is a section view of an embodiment having curved body surface and reverse scoop formed at the skirt.

The following description of the embodiments can be understood in light of the Figures which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals or word descriptions in different drawings represent the same element, and thus their descriptions may be omitted.

Definitions

Broadhead—an archery point having a triangular profile used primarily for hunting; the archery point having a point end and at least two primary blades that taper open or wider at the base end proximate the arrow shaft.

Blade—a tapered planer blade extending away perpendicular from the ferrule, the blade having at least the leading edge sharpened with a single bevel or double bevel grind. The blade may be a solid planer surface or may include a "window" cutting away a portion of the blade. A secondary blade that extends perpendicular to a primary blade through the window is included as a broadhead blade.

Ferrule—support structure for the broadhead blade, the ferrule may include a threaded shaft configured to be screwed or twisted into a ferrule insert or the ferrule may have a conical receiver for traditional arrows.

These definitions are for general understanding of the application of the present invention and should not be construed as limitations on the application or to replace accepted definitions in the archery arts.

Figure 1B:
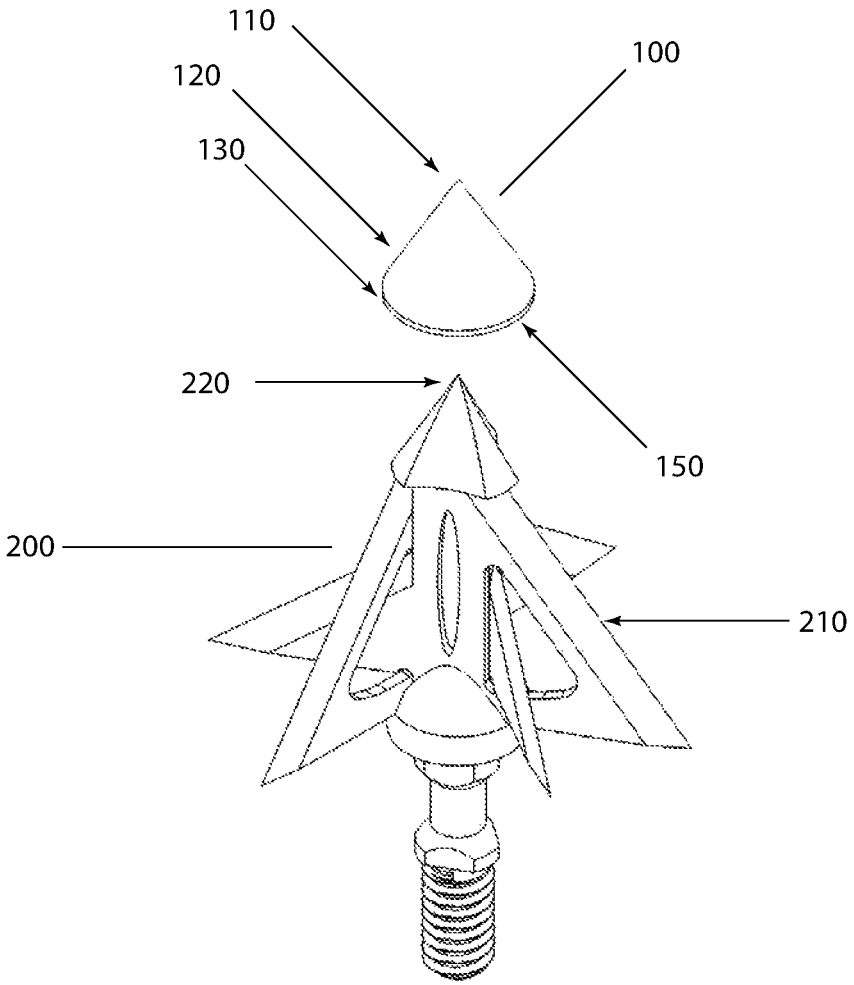

FIGS. 1A through 1B is a first embodiment of the present invention or archery broadhead airflow interrupter 100, the airflow interrupter 100 including a point 110, tapered sides 120 and skirt 130. The airflow interrupter 100 having a tapered central hole 150 in the base 140 extending from the base 140 toward the point, the central hole 150 configured to fit over the ferrule point 220 and up to the leading edge of the blades 210 of the broadhead 200. The central hole 150 sized to securely engage the point 220 and remain in place through the jostling and bumps expected during transportation in the field and during flight after the arrow is fired from a high velocity bow.

Figure 2A:
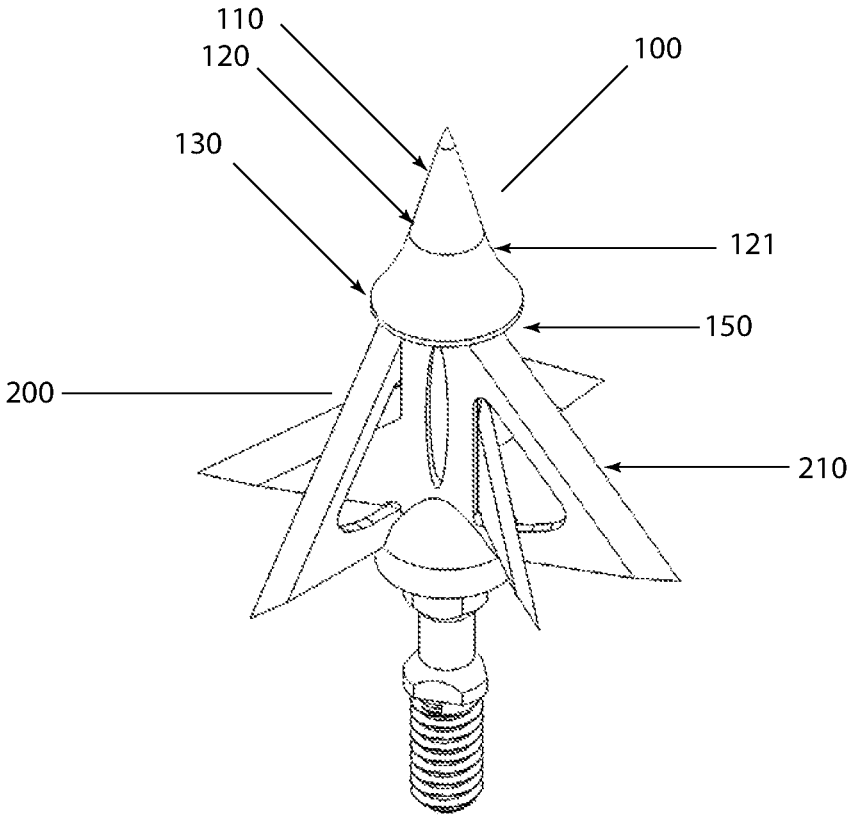
Figure 2B:
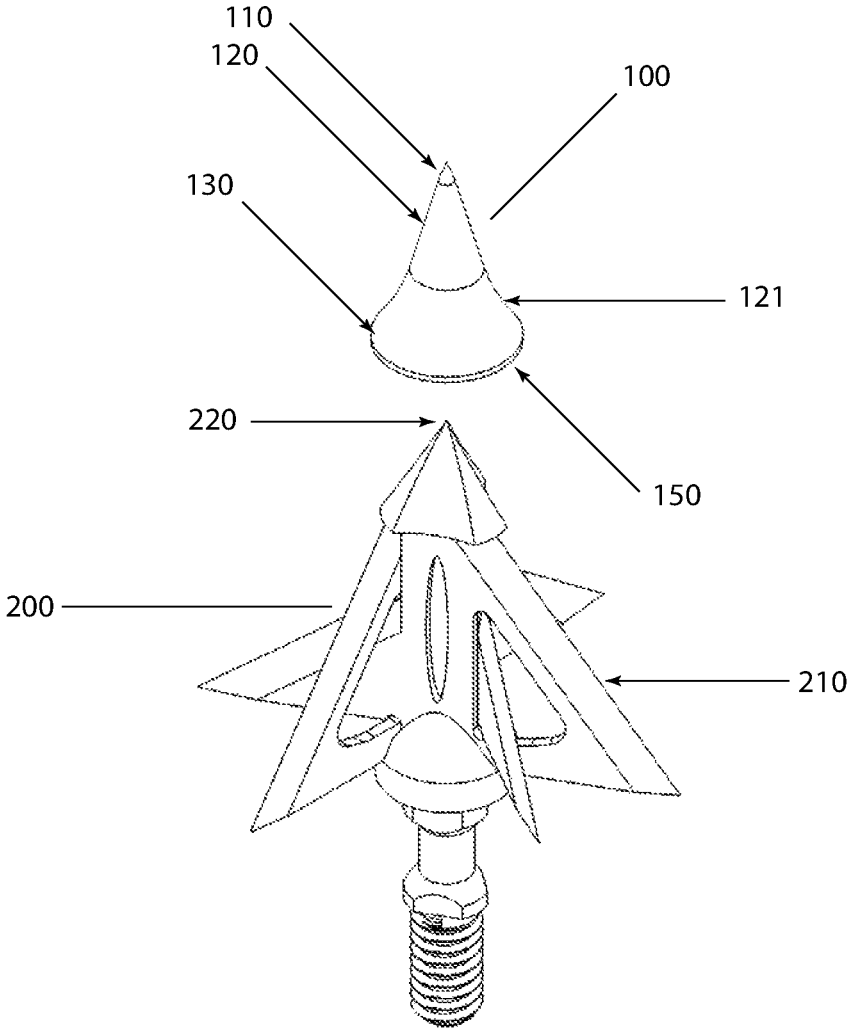

FIGS. 2A through 2B is another embodiment of the airflow interrupter 100 including a point 110 and tapered sides 120 including a convex portion 121 extending from the side taper 120 to the skirt 130. The convex portion 121 configured to create a ramp effect and further displace airflow around the broadhead blades 210.

Figure 3A:
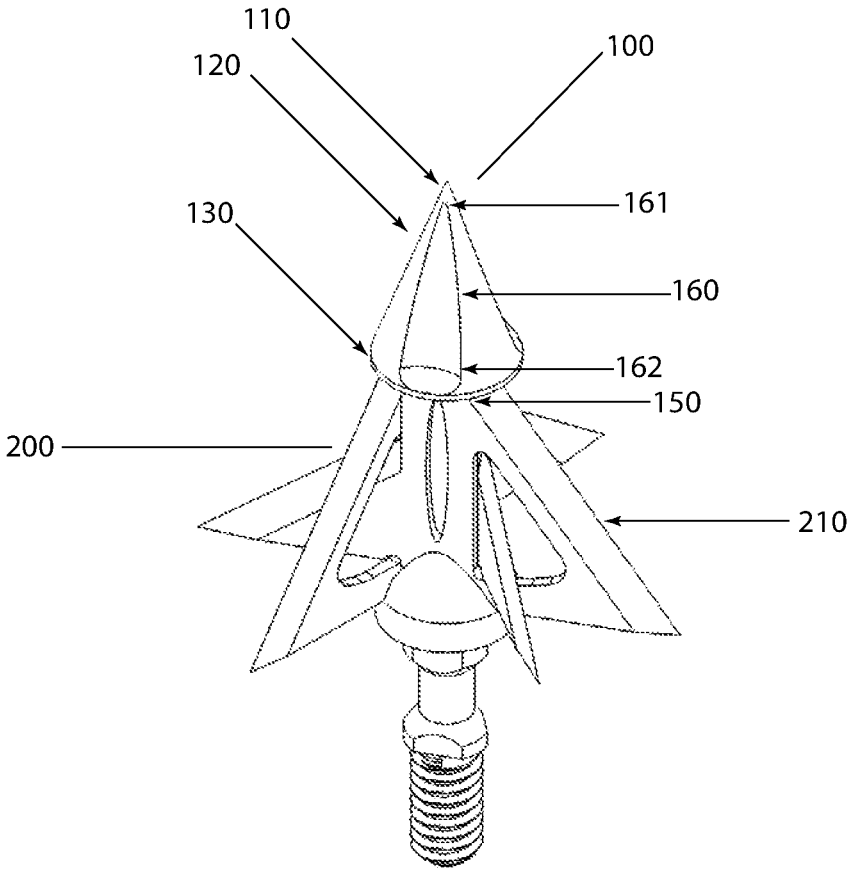
Figure 3B:
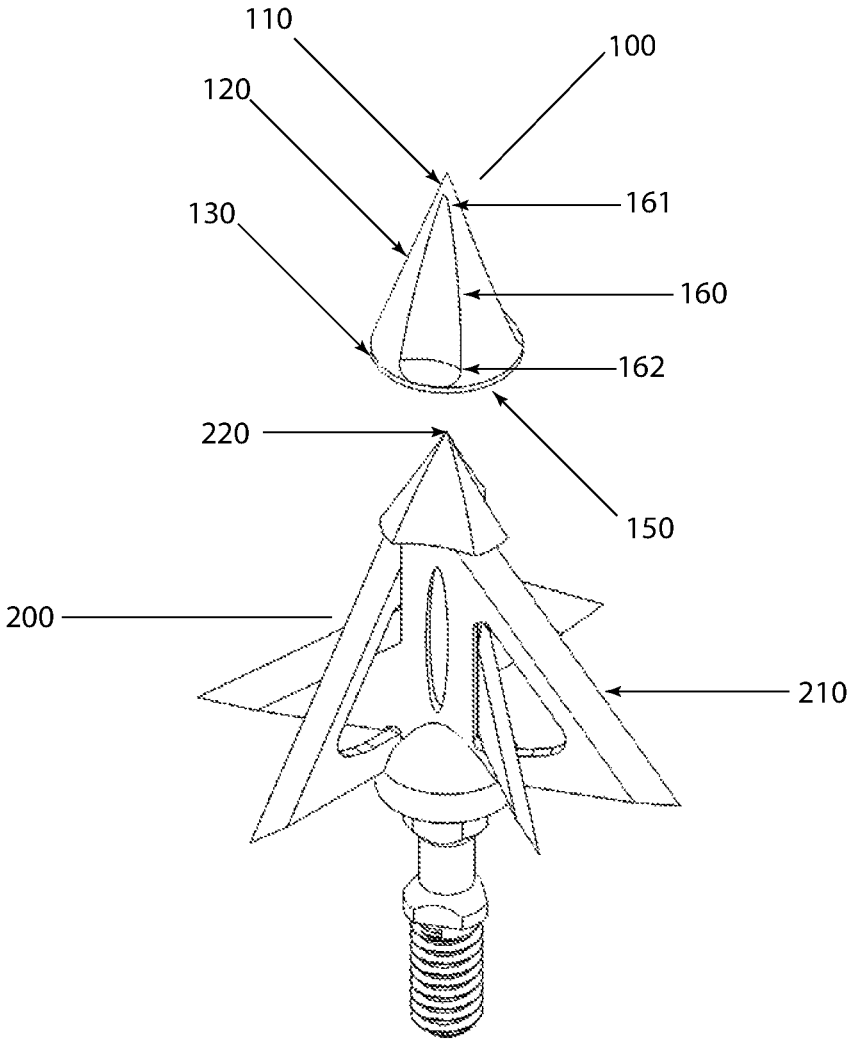

The embodiment disclosed in FIGS. 3A through 3B shows the airflow interrupter 100 including a plurality of indents or scallops 160 formed in a radial pattern on the tapered sides 120, the scallops 160 have a narrow point indentation 161 which broadens and extends down into a base indentation 162 designed to provide maximum air flow interruption. The scallops 160 may be 2, 3, 4 or any number allowed on the surface of the tapered sides 120 but the scallops 160 may be the same number as the number of primary blades 210 on the broadhead 200 and the scallops 160 can be aligned directly in line, or in the same vertical plane, with the broadhead blades 210. The scallops 160 may also act as a relief point or parting line allowing the airflow interrupter 100 to easily fracture and separate from the ferrule point 220.

Figure 4A:
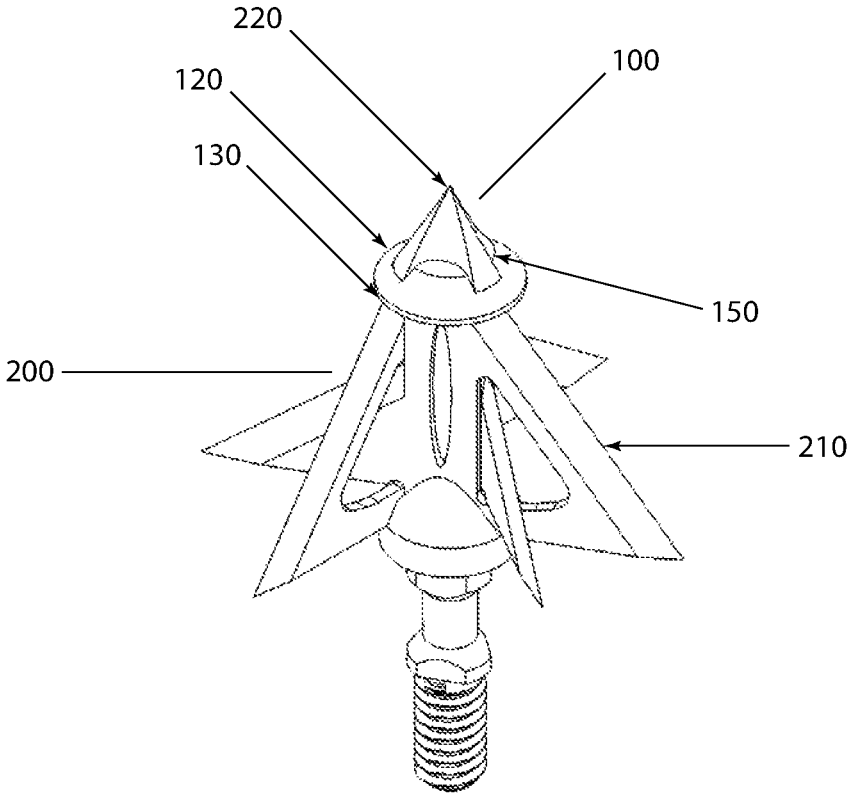
Figure 4B:
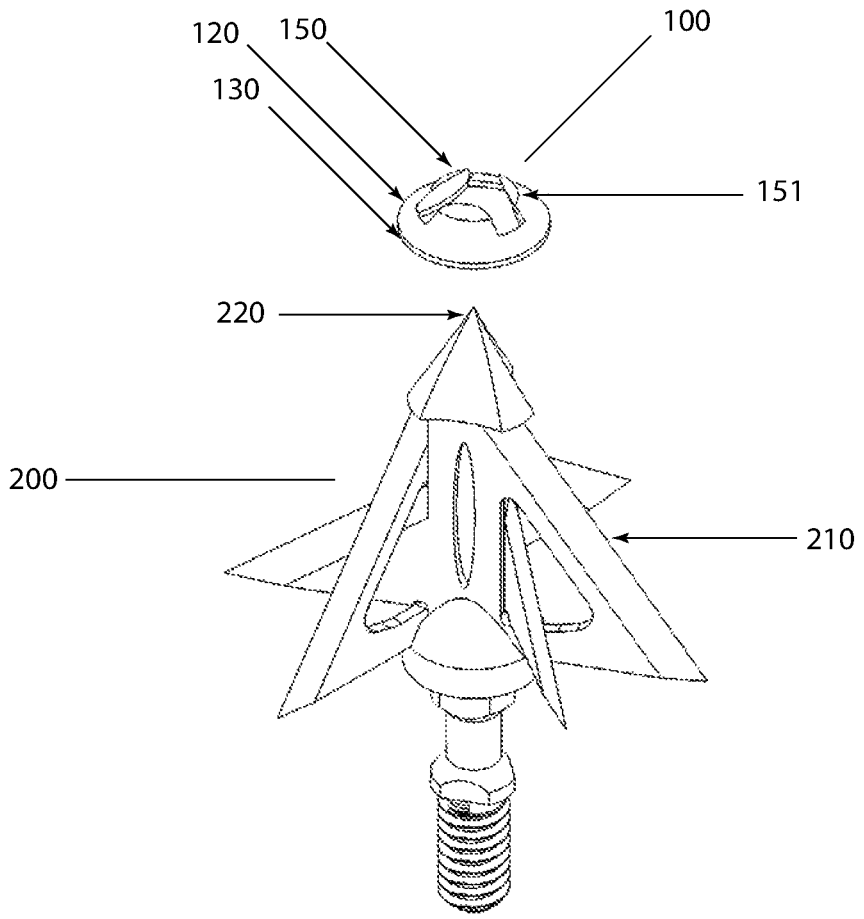

FIGS. 4A through 4B is yet another embodiment of the present invention or archery broadhead airflow interrupter 100. The airflow interrupter 100 formed substantially as a washer having a truncated side 120 extending down to a skirt portion 130. A central hole 150 configured to fit over the ferrule point 220. In one embodiment, the central hole 150 including a plurality of retainer flaps 151 configured to more securely hold the airflow interrupter 100 onto the ferrule point 220.

Figure 5:
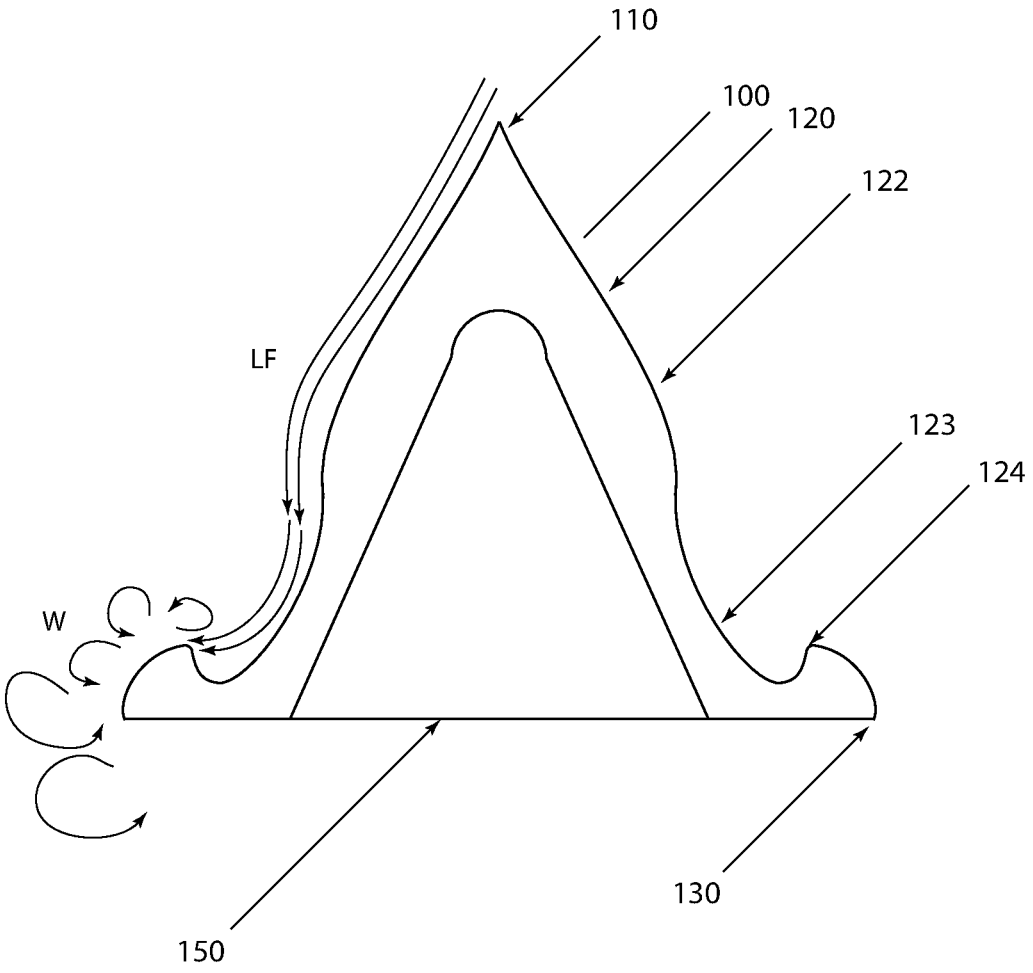

FIG. 5 is a vertical cross-section view of yet another embodiment of the airflow interrupter 100 of the present invention. The airflow interrupter 100 including a point 110, side portion 120 and skirt 130; the side portion including a bulbous shoulder 122, a convex recess 123 and a reverse scoop 124 formed just prior to the skirt 130. The bulbous shoulder 122 formed to direct air flow over the surface and cause the air to impact directly at the reverse scoop 124. Central hole 150 configured to securely fit over the ferrule point 220 of a broadhead 200.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. An archery broadhead air flow interrupter comprising,
a broadhead, comprising,
a ferrule point,
a plurality of cutting blades,
an air flow interrupter, comprising,
a point,
a body portion formed as conical taper extending from the point to a base,
a skirt portion formed at an edge of the base,
a central opening formed in the base,
the central opening configured to fit over the ferrule point, and,
the body portion covering the ferrule point without covering the cutting blades of the broadhead.

2. The air flow interrupter of claim 1 wherein the conical taper is substantially planer.

3. The air flow interrupter of claim 1 wherein the conical taper has a curved convex portion proximate the base forming a flared skirt.

4. The air flow interrupter of claim 1 wherein a plurality of scoops are formed in a radial pattern in the conical taper.

5. The air flow interrupter of claim 4 wherein the plurality of scoops is one of, 2, 3, and 4.

6. The air flow interrupter of claim 4 wherein the plurality of scoops equals a number of blades affixed to a reciprocal broadhead.

7. The air flow interrupter of claim 1 wherein the conical taper includes a bulbous contour proximate a mid-point between the point and the base,
a convex curved portion formed between the bulbous portion and the base,
a flared skirt formed at the base, and,
the skirt including a reverse air scoop.

8. The air flow interrupter of claim 1 comprising one of a plastic and silicon.

9. The air flow interrupter of claim 1 comprising a biodegradable material one of, corn starch, potato starch, soybean protein, and cellulose.

10. An archery broadhead air flow interrupter comprising,
a broadhead, comprising,
a ferrule point,
a plurality of cutting blades,
an air flow interrupter, comprising,
a body portion formed as a washer,
the washer having,
a tapered side,
a lower skirt portion, and,
a central hole configured to fit over a ferrule point of a broadhead,
the washer fitting over the ferrule point without covering the cutting blades of the broadhead, and, leaving the ferrule point exposed.

11. The air flow interrupter of claim 10 wherein a plurality of retainer flaps are formed in a radial pattern extending into the central hole.

12. The air flow interrupter of claim 10 configured to fit into a groove formed in a broadhead ferrule.

13. The air flow interrupter of claim 10 wherein the interrupter is reusable.

* * * * *